US009458742B2

(12) United States Patent
Suzuki

(10) Patent No.: US 9,458,742 B2
(45) Date of Patent: Oct. 4, 2016

(54) VARIABLE VALVE MECHANISM FOR INTERNAL COMBUSTION ENGINE

(71) Applicant: TOYOTA JIDOSHA KABUSHIKI KAISHA, Toyota-shi (JP)

(72) Inventor: Masaru Suzuki, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/794,146

(22) Filed: Jul. 8, 2015

(65) Prior Publication Data

US 2016/0017769 A1 Jan. 21, 2016

(30) Foreign Application Priority Data

Jul. 16, 2014 (JP) ..... 2014-145640

(51) Int. Cl.

| | |
|---|---|
| ***F01L 1/34*** | (2006.01) |
| ***F01L 1/344*** | (2006.01) |
| ***F01L 1/08*** | (2006.01) |
| ***F01L 1/26*** | (2006.01) |
| ***F01L 13/00*** | (2006.01) |
| ***F01L 1/047*** | (2006.01) |

(52) U.S. Cl.

CPC ..... *F01L 1/344* (2013.01); *F01L 1/047* (2013.01); *F01L 1/08* (2013.01); *F01L 1/267* (2013.01); *F01L 13/0031* (2013.01); *F01L 13/0063* (2013.01)

(58) Field of Classification Search

CPC ..... F01L 1/08; F01L 1/047; F01L 1/267; F01L 1/344; F01L 13/0063

USPC ..... 123/90.16, 90.18, 90.6

See application file for complete search history.

(56) References Cited

U.S. PATENT DOCUMENTS 7,540,266 B2 * 6/2009 Tsuzuki ..... F01L 1/34 123/90.15

2005/0154522 A1 7/2005 Fuwa et al.

FOREIGN PATENT DOCUMENTS

| | | |
|---|---|---|
| JP | 2004-339951 | 12/2004 |
| JP | 2005-201117 | 7/2005 |
| JP | 2014-156793 | 8/2014 |
| JP | 2015-121201 A | 7/2015 |

* cited by examiner

*Primary Examiner* — Ching Chang

(74) *Attorney, Agent, or Firm* — Oblon, McClelland, Maier & Neustadt, L.L.P.

(57) ABSTRACT

A variable valve mechanism for an internal combustion engine includes a control shaft and a cam. The control shaft is configured to change a maximum lift amount of an engine valve according to displacement of the control shaft. The cam is configured to displace the control shaft in the axial direction due to rotation of the cam. The cam surface includes change zones and retention zones. Respective lengths of the retention zones in a rotation direction of the cam is set such that respective length of the retention zones in the rotation direction increases as the maximum lift amount retained by the retention zones increases.

4 Claims, 8 Drawing Sheets

VARIABLE VALVE MECHANISM FOR INTERNAL COMBUSTION ENGINE

INCORPORATION BY REFERENCE

The disclosure of Japanese Patent Application No. 2014-145640 filed on Jul. 16, 2014 including the specification, drawings and abstract is incorporated herein by reference in its entirety.

BACKGROUND OF THE INVENTION

1. Field of the Invention

The present invention relates to a variable valve mechanism for an internal combustion engine.

2. Description of Related Art

There has been known a variable valve mechanism that changes a maximum lift amount of an intake valve, which is one of engine valves, according to an engine operation state, as described in Japanese Patent Application Publication No. 2004-339951 (JP 2004-339951 A), for example. The variable valve mechanism described in JP 2004-339951 A includes: a control shaft that changes a maximum lift amount of the intake valve according to displacement in an axial direction; a cam that abuts with the control shaft and rotates the control shaft so as to displace the control shaft in the axial direction; a motor that pivots the cam, and the like. The maximum lift amount is changed by changing a rotational phase of the cam so as to change a displacement amount of the control shaft in the axial direction. In a cam surface of the cam, a change zone in which the maximum lift amount changes due to changes in the displacement amount of the control shaft, and a retention zone in which the displacement amount of the control shaft is constant and the maximum lift amount is retained at a constant value are formed. In the variable valve mechanism, the maximum lift amount is changed by changing the displacement amount of the control shaft by use of the cam surface in the change zone. Meanwhile, by retaining the displacement amount of the control shaft at a constant value by use of the cam surface in the retention zone, the maximum lift amount is retained at a constant value even when current application to the motor is stopped. Further, as such a retention zone, a plurality of retention zones in which to retain different maximum lift amounts is provided, thereby making it possible to retain the different maximum lift amounts.

SUMMARY OF THE INVENTION

A force in the axial direction (hereinafter referred to as an axial force) caused due to a reaction force of a valve spring that biases the engine valve is applied to the control shaft. The axial force is also transmitted to the cam via the control shaft. A magnitude of the axial force periodically changes according to changes in a compression amount of the valve spring along with opening/closing operations of the engine valve. Further, as the compression amount of the valve spring is larger, that is, as the maximum lift amount is larger, a maximum value of the axial force becomes larger.

Here, when the maximum lift amount is retained by use of the cam surface in the retention zone, a running torque caused due to the axial force may act on the cam. In this case, a magnitude of the running torque also periodically changes in accordance with periodic changes of the axial force. As a result, the cam swings according to such periodic changes of the running torque. Further, such a swing amount of the cam increases as a retained maximum lift amount is larger and the axial force is hereby larger. Accordingly, the swing amount of the cam might increase excessively depending on a magnitude of the retained maximum lift amount. In some cases, the control shaft that should abut with the cam surface in the retention zone might deviate from the retention zone and abut with the cam surface in the change zone.

When the control shaft deviates from the retention zone of the cam as such, it is difficult to obtain an effect to retain the maximum lift amount by use of the retention zone, for example, that is, an effect to be able to retain the maximum lift amount at a constant value even if current application to the motor is stopped as described above. This accordingly causes inconvenience that power consumption of the motor increases, and so on.

The present invention provides a variable valve mechanism for an internal combustion engine which variable valve mechanism restrains an abutment portion between a control shaft and a cam from deviating from a retention zone provided in the cam at the time when a maximum lift amount is retained by use of the retention zone.

A variable valve mechanism for an internal combustion engine according to one aspect of the present invention includes a control shaft and a cam. The control shaft is configured to be displaced in an axial direction of the control shaft. The control shaft is configured to change a maximum lift amount of an engine valve of the internal combustion engine according to displacement of the control shaft. The cam includes a cam surface of the cam. The cam surface is configured to abut with the control shaft. The cam is configured to displace the control shaft in the axial direction due to rotation of the cam. The cam surface includes change zones and retention zones. The cam surface in the change zones is configured to change the maximum lift amount along with the rotation of the cam. The cam surface in the retention zones is configured to retain the maximum lift amount along with the rotation of the cam. Respective lengths of the retention zones in a rotation direction of the cam are set such that respective length of the retention zones in the rotation direction increases as the maximum lift amount retained by the retention zones increases.

In the variable valve mechanism according to the above aspect, the retention zone with a larger maximum lift amount to be retained, that is, the retention zone in which a swing amount at the time when the cam swings due to an axial force transmitted from the control shaft easily increases has a longer length in a rotation direction of the cam. Accordingly, even if the swing amount of the cam becomes large, an abutment portion between the control shaft and the cam is hard to deviate from the retention zone.

In the meantime, when the retention zone is set to be long, a necessary rotational phase amount of the cam to change the abutment portion between the control shaft and the cam from the retention zone to the change zone becomes large. Accordingly, a change velocity to change the maximum lift amount decreases. In this regard, in the above configuration, a retention zone with a larger maximum lift amount to be retained is set to have a longer length, whereas a retention zone with a smaller maximum lift amount to be retained is set to have a shorter length. Accordingly, in comparison with a case where all the retention zones are set to have sufficiently long lengths in accordance with a maximum value of the swing amount of the cam, the retention zone with a smaller maximum lift amount to be retained has a smaller necessary rotational phase amount of the cam to change the abutment portion from the retention zone to the change zone.

Accordingly, it is possible to appropriately restrain a decrease in a change velocity to change the maximum lift amount.

In the variable valve mechanism according to the above aspect, in the cam surface, the retention zones may be provided so as to be adjacent to the change zones. According to the above aspect, the maximum lift amount changed by use of the change zone can be retained in the retention zone adjacent to the change zone.

In the variable valve mechanism according to the above aspect, the cam surface in the change zones may be configured such that a cam diameter of the cam continuously increases along with the rotation of the cam such that the maximum lift amount increases along with the rotation of the cam. The cam surface in the retention zones may be a flat surface.

According to the above aspect, since the maximum lift amount changes continuously in the change zones, sudden changes in an intake-air amount along with changes of the maximum lift amount can be restrained. Accordingly, sudden changes in engine power torque or the like due to the sudden changes in the intake-air amount can be restrained, for example.

Further, the cam surface in the retention zones is formed to be a flat surface. Accordingly, a cam shape in the retention zones is a shape in which the cam diameter gradually increases after the cam diameter gradually decreases as the rotational phase of the cam changes in one direction, that is, a shape having a minimum point about the cam diameter. In such a cam shape having a minimum point, when the control shaft deviates from the cam surface at the minimum point, a component force of the axial force acts to return the rotational phase of the cam back to the minimum point. Due to the action of the component force, when the control shaft makes contact with the cam surface in the retention zone, the rotational phase of the cam is naturally directed toward the minimum point in the retention zone, so that the maximum lift amount is retained at an amount according to the cam diameter at the minimum point. Thus, according to the configuration, with such a simple structure in which the cam includes a cam surface in which the cam diameter continuously changes and the cam surface formed to be a flat surface, it is possible to embody change and retention of the maximum lift amount.

In the variable valve mechanism according to the above aspect, the cam surface in the change zones may be configured such that a cam diameter of the cam continuously increases along with the rotation of the cam such that the maximum lift amount increases along with the rotation of the cam. The cam surface in the retention zone may be configured such that the cam diameter is constant.

In the variable valve mechanism according to the above aspect, since the maximum lift amount changes continuously in the change zones, sudden changes in an intake-air amount along with changes in the maximum lift amount can be restrained. Accordingly, sudden changes in engine power torque or the like due to the sudden changes in the intake-air amount can be restrained, for example.

Further, since the cam diameter in the retention zone is formed so as to be constant, the displacement amount of the control shaft does not change in the retention zone. Accordingly, the maximum lift amount in the retention zone is retained at an amount according to the cam diameter thus formed to be constant. Thus, according to the configuration, with such a simple structure in which the cam includes a cam surface in which the cam diameter continuously changes and a cam surface formed so that the cam diameter is constant, it is possible to embody change and retention of the maximum lift amount.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
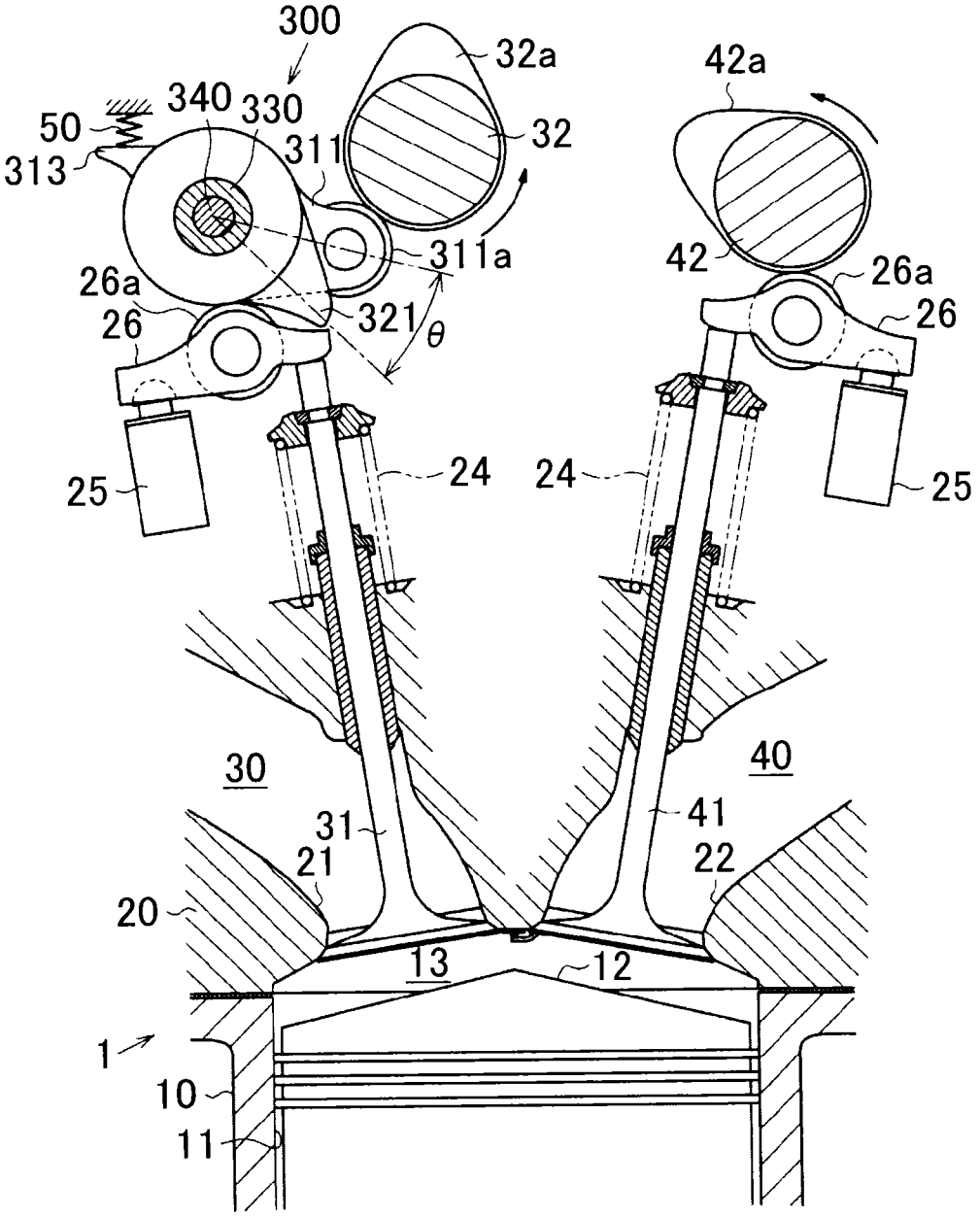
FIG. 1 is a sectional view illustrating a structure around a cylinder head of an internal combustion engine to which one embodiment of a variable valve mechanism is applied.

One embodiment of a variable valve mechanism for an internal combustion engine is described below with reference to FIGS. 1 to 7. As illustrated in FIG. 1, an internal combustion engine 1 includes a cylinder block 10 and a cylinder head 20 provided on the cylinder block 10.

Cylindrical cylinders 11 according to the number of cylinders are formed inside the cylinder block 10, and a piston 12 is slidably accommodated in each of the cylinders 11. The cylinder head 20 is assembled to an upper side of the cylinder block 10, and a combustion chamber 13 is formed to be sectioned by an inner peripheral surface of the cylinder 11, a top face of the piston 12, and a bottom face of the cylinder head 20.

The cylinder head 20 is provided with an inlet port 21 communicating with an intake passage 30 and the combustion chamber 13, and an exhaust port 22 communicating with an exhaust passage 40 and the combustion chamber 13. The intake passage 30 is provided with a throttle valve driven by an actuator.

The inlet port 21 is provided with an intake valve 31 as an engine valve for communicating the combustion chamber 13 with the inlet port 21 and disconnecting the combustion chamber 13 from the inlet port 21. The exhaust port 22 is provided with an exhaust valve 41 as an engine valve for communicating the combustion chamber 13 with the exhaust port 22 and disconnecting the combustion chamber 13 from the exhaust port 22. The intake valve 31 and the exhaust valve 41 are biased by valve springs 24 in a valve closing direction.

Further, a lash adjuster 25 is provided inside the cylinder head 20 so as to correspond to each of the valves 31, 41. A rocker arm 26 is provided between the lash adjuster 25 and the each of the valves 31, 41. One end of the rocker arm 26 is supported by the lash adjuster 25, and the other end thereof abuts with an end part of the each of the valves 31, 41.

Further, an intake camshaft 32 and an exhaust camshaft 42 for driving the valves 31, 41, respectively, are rotatably supported in the cylinder head 20. An intake cam 32*a* is formed in the intake camshaft 32, and an exhaust cam 42*a* is formed in the exhaust camshaft 42. A roller 26*a* of the rocker arm 26 abutting with the exhaust valve 41 abuts with an outer peripheral surface of the exhaust cam 42*a*. Hereby, when the exhaust camshaft 42 rotates during an engine operation, the rocker arm 26 swings, due to action of the exhaust cam 42*a*, with a part supported by the lash adjuster 25 being taken as a fulcrum. Due to the swing of the rocker arm 26, the exhaust valve 41 is opened and closed.

In the meantime, a variable mechanism portion 300 for changing valve characteristics of the intake valve 31 is provided between the rocker arm 26 abutting with the intake valve 31 and the intake cam 32*a*, and the variable mechanism portion 300 is provided for each cylinder. The variable mechanism portion 300 constitutes part of a variable valve mechanism 600, and includes an input arm 311 and an output arm 321. The input arm 311 and the output arm 321 are swingably supported around a support pipe 330 fixed to the cylinder head 20. The rocker arm 26 is biased toward an output-arm-321 side by a biasing force of the valve spring 24, so that a roller 26*a* provided in an intermediate part of the rocker arm 26 abuts with an outer peripheral surface of the output arm 321.

Further, a projection 313 is provided on an outer peripheral surface of the variable mechanism portion 300, and a biasing force of a spring 50 fixed inside the cylinder head 20 acts on the projection 313. Due to the biasing force of the spring 50, a roller 311*a* provided in a tip end of the input arm 311 abuts with an outer peripheral surface of the intake cam 32*a*. Hereby, when the intake camshaft 32 rotates during an engine operation, the variable mechanism portion 300 swings around the support pipe 330 due to action of the intake cam 32*a*. Then, the rocker arm 26 is pressed by the output arm 321, so that the rocker arm 26 swings with a part supported by the lash adjuster 25 being taken as a fulcrum. Due to the swing of the rocker arm 26, the intake valve 31 is opened and closed.

A control shaft 340 movable along an axial direction of the support pipe 330 is inserted into the support pipe 330. The variable mechanism portion 300 displaces the control shaft 340 in the axial direction, so as to change a relative phase difference between the input arm 311 and the output arm 321 around the support pipe 330, namely, an angle θ shown in FIG. 1.

Figure 2:
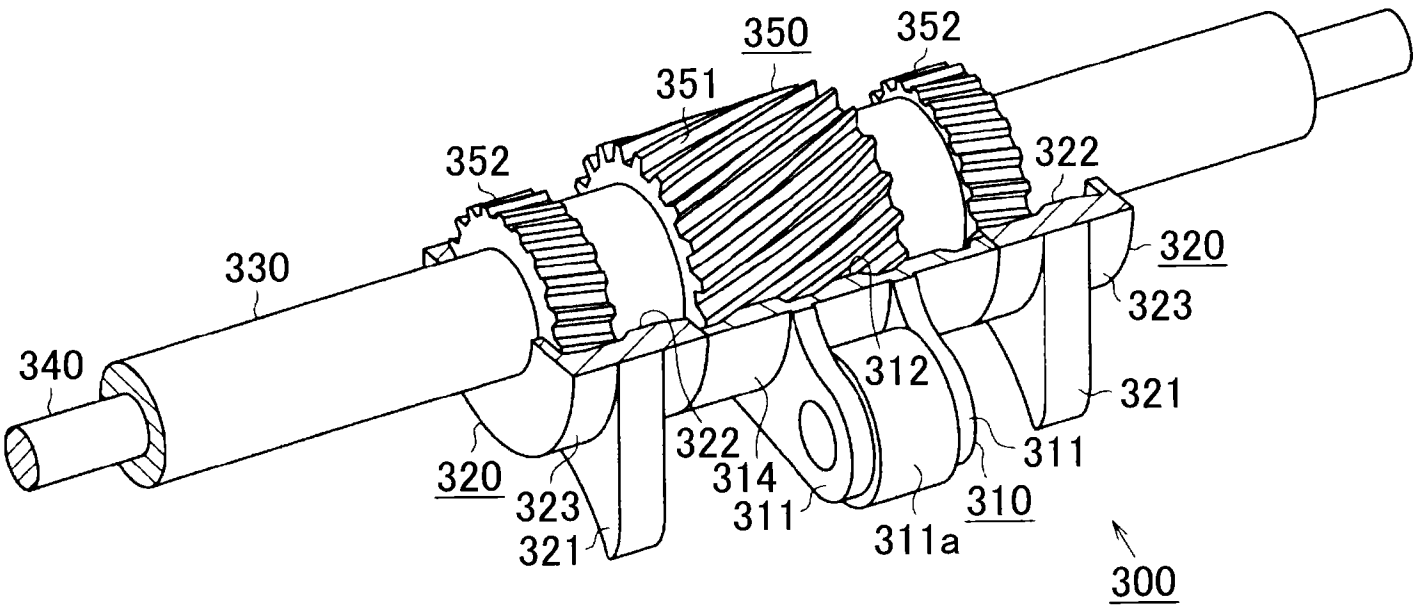
FIG. 2 is a cutaway perspective view of a variable mechanism portion.

Referring now to FIG. 2, a configuration of the variable mechanism portion 300 is described below further in detail. As illustrated in FIG. 2, output portions 320 are provided in the variable mechanism portion 300 across an input portion 310 such that the output portions 320 are disposed on both sides of the input portion 310.

A housing 314 of the input portion 310 and housings 323 of the output portions 320 are each formed in a hollow cylinder shape, and the support pipe 330 is passed through the housings 314, 323.

Helical splines 312 are formed on an inner periphery of the housing 314 of the input portion 310. In the meantime, helical splines 322 with flank lines along a direction opposite to the helical splines 312 of the input portion 310 are formed on an inner periphery of the housing 323 of each of the output portions 320.

A slider gear 350 is disposed in a consecutive internal space formed by respective housings 314, 323 of the input portion 310 and two output portions 320. The slider gear 350 is formed in a hollow cylindrical shape, and is disposed on an outer peripheral surface of the support pipe 330 in a reciprocating manner along an axial direction of the support pipe 330 and in a relatively rotatable manner around an axis of the support pipe 330.

Helical splines 351 meshed with the helical splines 312 of the input portion 310 are formed on an outer peripheral surface of an axially central part of the slider gear 350. In the meantime, helical splines 352 meshed with the helical splines 322 of the output portions 320 are formed on respective outer peripheral surfaces of both axially end parts of the slider gear 350.

A control shaft 340 movable along the axial direction of the support pipe 330 is provided inside the support pipe 330. The control shaft 340 is engaged with the slider gear 350 with a pin, and the slider gear 350 can pivot relative to the support pipe 330 and also moves along the axial direction association with axial movement of the control shaft 340.

In the variable mechanism portion 300 configured as such, when the control shaft 340 moves in the axial direction, the slider gear 350 also moves in the axial direction in association with the movement of the control shaft 340. The helical splines 351, 352 formed on the outer peripheral surface of the slider gear 350 have flank lines along different formation directions, and are meshed with respective helical splines 312, 322 formed on the inner peripheral surfaces of the input portion 310 and the output portion 320. Accordingly, when the slider gear 350 moves in the axial direction, the input portion 310 and the output portion 320 pivot in opposite directions. As a result, a relative phase difference between the input arm 311 and the output arm 321 is changed, so that a maximum lift amount and a valve opening period, which are valve characteristics of the intake valve 31, are changed. More specifically, when the control shaft 340 is moved in a direction where the maximum lift amount increases, the slider gear 350 is also moved in the same direction together with the control shaft 340. In association with this, the relative phase difference between the input arm 311 and the output arm 321, that is, the angle θ shown in FIG. 1 increases, so that a maximum lift amount VL and a valve opening period of the intake valve 31 increase, thereby increasing an intake-air volume. In the meantime, when the control shaft 340 is moved in a direction where the maximum lift amount decreases, the slider gear 350 is also moved in the same direction together with the control shaft 340, so that the relative phase difference between the input arm 311 and the output arm 321, that is, the angle θ shown in FIG. 1 decreases. Hereby, the maximum lift amount VL and the valve opening period of the intake valve 31 both decrease, so that the intake-air amount decreases.

Figure 3:
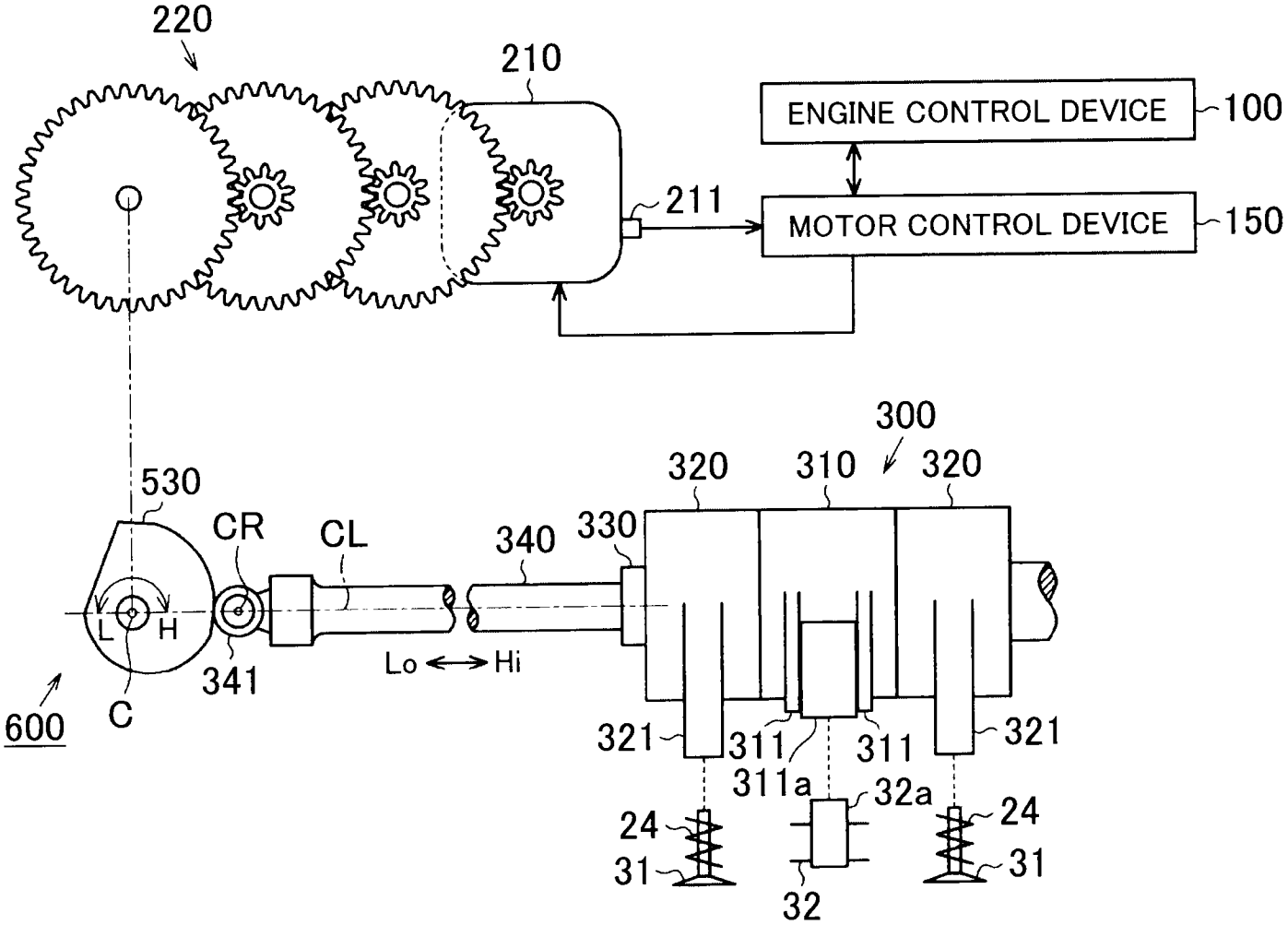
FIG. 3 is a schematic view of the variable valve mechanism.

Next will be described a configuration of a driving portion for moving the control shaft 340 of the variable valve mechanism 600 in the axial direction. As illustrated in FIG. 3, the driving portion of the variable valve mechanism 600 includes: a motor 210; a deceleration mechanism 220 for decreasing a rotation speed of the motor 210; a cam 530 with which a roller 341 provided in an end part of the control shaft 340 abuts; and the like.

A rotation center CR of the roller 341 and a rotation center C of the cam 530 are disposed on an extended line of a central axis CL of the control shaft 340. The motor 210 is a duty-driven electric motor, and the motor 210 is provided with a rotation angle sensor 211 for detecting a rotation angle.

The deceleration mechanism 220 includes a plurality of gears meshed with each other. An input shaft of the deceleration mechanism 220 is connected to an output shaft of the motor 210, and an output shaft of the deceleration mechanism 220 is connected to a central shaft of the cam 530. When the cam 530 pivots, the control shaft 340 is displaced in an axial direction, which is a direction in which a central axis of the control shaft 340 extends, along with changes in a cam diameter (a distance from a rotation center of the cam to a cam surface).

A motor control device 150 for controlling driving of the motor 210 is connected to the motor 210. A rotation angle of the motor 210 is controlled in response to a driving signal from the motor control device 150. The motor control device 150 is connected to an engine control device 100 for controlling an operation state of the internal combustion engine 1.

An accelerator operation amount detected by an accelerator operation amount sensor, a crank angle detected by a crank angle sensor, an opening degree (a throttle opening degree TA) of a throttle valve which opening degree is detected by an opening degree sensor, an intake-air amount GA detected by an air-flow meter and the like are input to the engine control device 100. Then, the engine control device 100 calculates a target air amount GAp, which is a target value of an intake-air amount according to an engine operation state, based on an engine rotation speed NE calculated from the crank angle, the accelerator operation amount ACCP, and the like, for example, and calculates a combination of the throttle opening degree and that maximum lift amount of the intake valve 31 which is obtained from the target air amount GAp. Then, the maximum lift amount thus calculated is set as a target lift amount VLp, and the throttle opening degree thus calculated is set as a target throttle opening degree TAp. When the target lift amount VLp is set as such, a target rotational phase Kp of the cam 530 corresponding to the target lift amount VLp is calculated in the motor control device 150, and a rotation angle of the motor 210 is feedback-controlled so that a rotational phase of the cam 530 reaches the target rotational phase Kp thus calculated. Further, when the target throttle opening degree TAp is set, the engine control device 100 drive-controls the actuator of the throttle valve so that an actual throttle opening degree TA accords with the target throttle opening degree TAp.

Further, the motor control device 150 calculates an actual rotational phase K of the cam 530 from that rotation angle of the motor 210 which is detected by the rotation angle sensor 211, and then calculates a current value of the maximum lift amount VL from the rotational phase K thus calculated. Then, the motor control device 150 transmits the calculated current value of the maximum lift amount VL to the engine control device 100.

Figure 4:
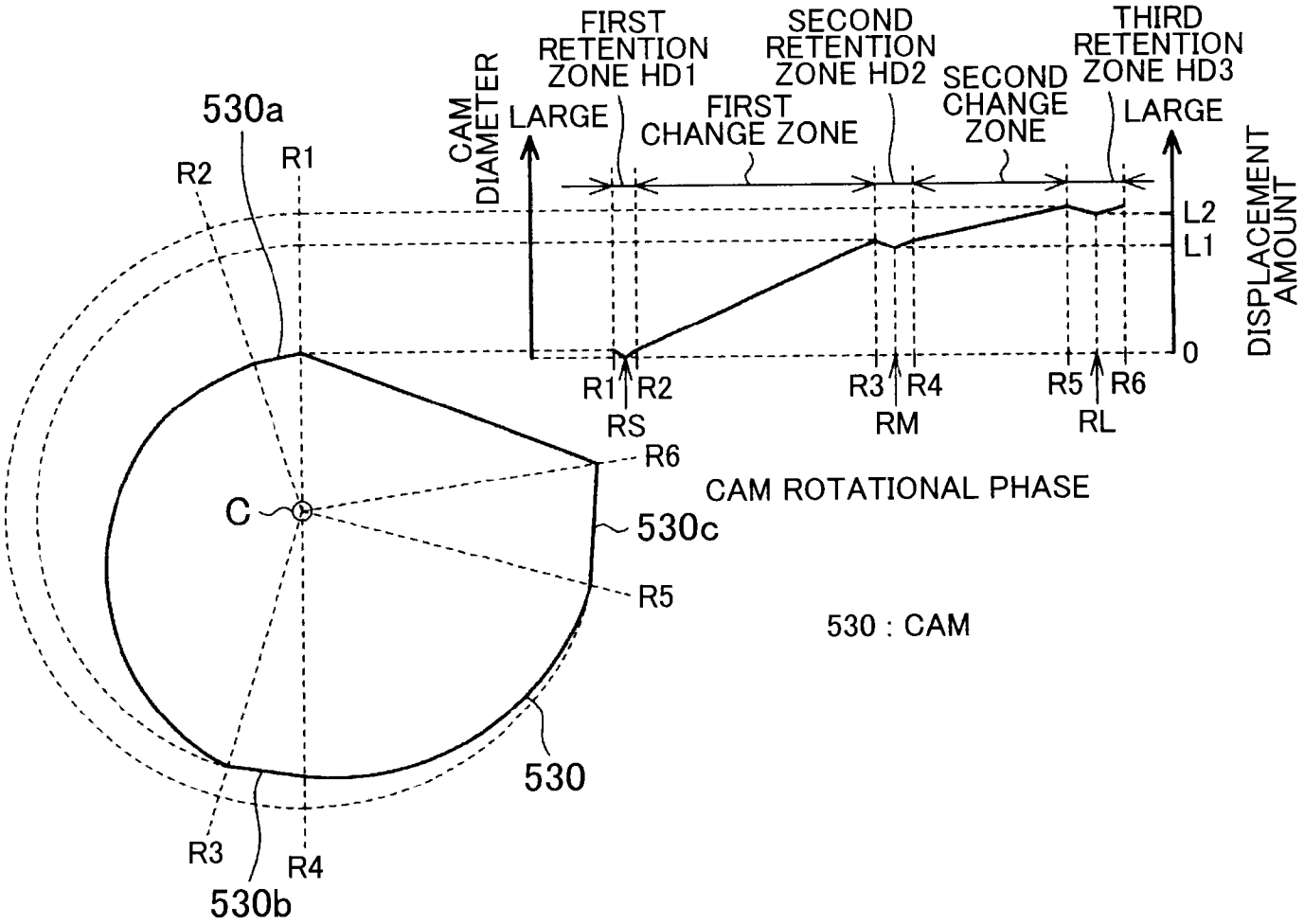
FIG. 4 is a view illustrating a profile and a cam diagram of a cam provided in the variable valve mechanism.
Figure 5:
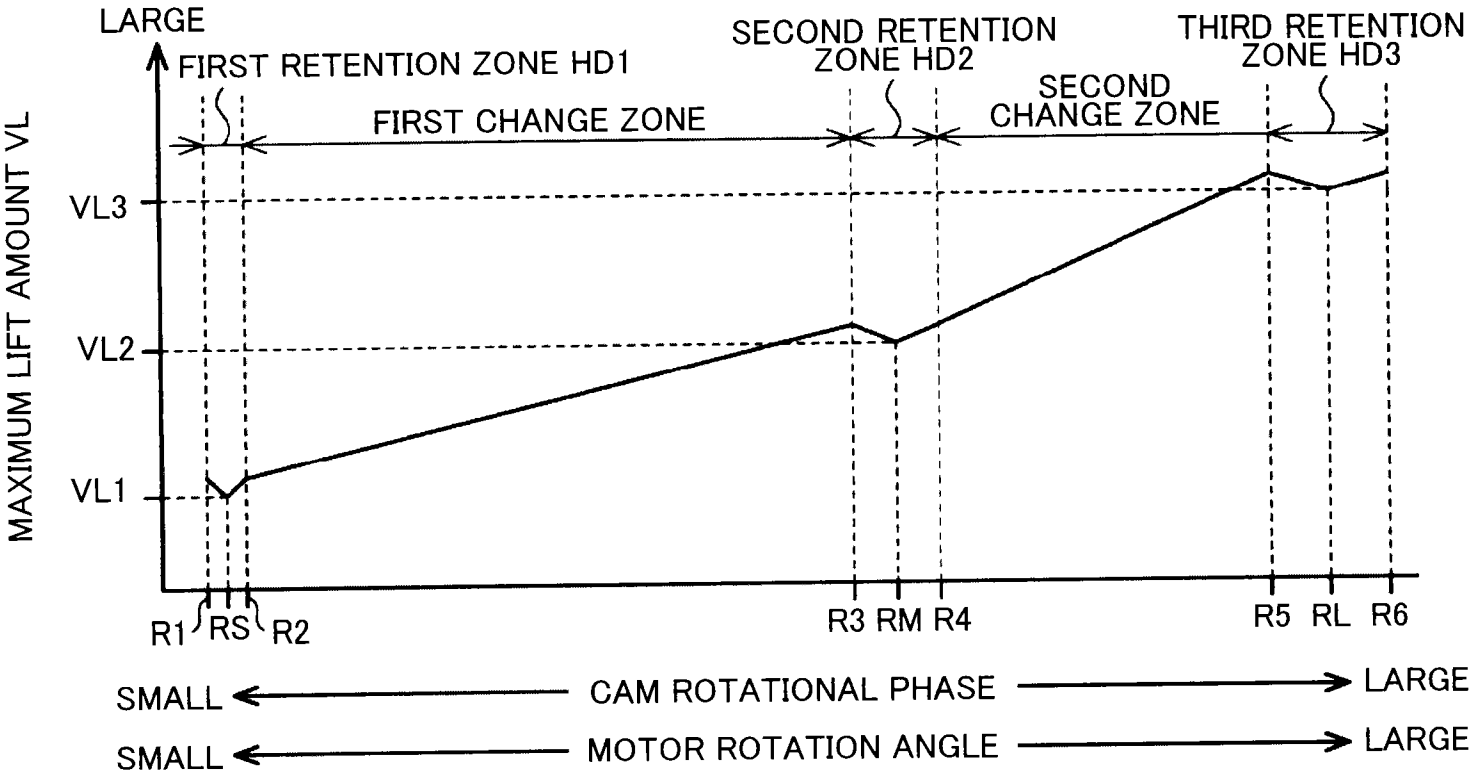
FIG. 5 is a graph illustrating a change mode of a maximum lift amount by the variable valve mechanism.

Referring now to FIGS. 4 and 5, the cam 530 for displacing the control shaft 340 is described below. A cam diagram illustrating a relationship between a rotational phase of the cam 530 and a displacement amount of the control shaft 340 is illustrated on a right side in FIG. 4, and a cam profile (an actual shape of the cam 530) formed based on the cam diagram is illustrated on a left side in FIG. 4. Note that, in the following description, a direction in which the rotational phase of the cam 530 is changed in order of a first rotational phase R1, a second rotational phase R2, and a third rotational phase R3 (a direction in which the cam 530 is rotated right-handedly (clockwise) in FIG. 4) is defined as a direction in which the rotational phase of the cam 530 is increased.

As illustrated in FIG. 4, three retention zones formed in a flat shape are provided on a cam surface of the cam 530 at intervals. More specifically, a first flat portion 530*a* constituting a first retention zone HD1 is provided in a zone between the first rotational phase R1 and the second rotational phase R2. A second flat portion 530*b* constituting a second retention zone HD2 is provided in a zone between the third rotational phase R3 and a fourth rotational phase R4. A third flat portion 530*c* constituting a third retention zone HD3 is provided in a zone between a fifth rotational phase R5 and a sixth rotational phase R6. Both ends of each of the retention zones HD1 to HD3 in a rotation direction of the cam have the same cam diameter, so that a part between the both ends is formed in a flat shape as described above.

Further, as illustrated in the cam diagram of FIG. 4, respective lengths of the retention zones HD1 to HD3 are set so as to become longer in order of the first retention zone HD1<the second retention zone HD2<the third retention zone HD3. In other words, in a case where a rotational phase amount between the first rotational phase R1 and the second rotational phase R2 is assumed a reference amount, a rotational phase amount between the third rotational phase R3 and the fourth rotational phase R4 is set to be larger than the reference amount. Further, a rotational phase amount between the fifth rotational phase R5 and the sixth rotational phase R6 is set to be larger than the rotational phase amount between the third rotational phase R3 and the fourth rotational phase R4.

In the meantime, as illustrated in FIG. 3 and the like, since a reaction force of the valve spring 24 acts on the output arm 321 of the variable mechanism portion 300, a force to decrease the relative phase difference (the angle θ shown in FIG. 1) between the input arm 311 and the output arm 321 acts. Accordingly, an axial force in a direction (a direction indicated by an arrow Lo in FIG. 2 and FIG. 3) where the maximum lift amount of the intake valve 31 decreases acts on the slider gear 350 and the control shaft 340. In the variable valve mechanism 600, the roller 341 is being pressed against the cam surface of the cam 530 due to such an axial force.

When such an axial force acts on a zone in which the cam diameter gradually changes in the cam surface, a component force of the axial force is caused. The component force of the axial force acts as a force to rotate the cam 530 in a direction where the cam diameter decreases.

Here, as described above, the retention zones HD1 to HD3 in the cam surface of the cam 530 are each formed in a flat shape. Accordingly, as illustrated in FIG. 4, a cam profile of each of the retention zones HD1 to HD3 has a shape in which the cam diameter gradually increases after the cam diameter gradually decreases as the rotational phase of the cam 530 changes in one direction, that is, a shape having a minimum point about the cam diameter.

Accordingly, in a rotational phase range of the cam 530 in the first retention zone HD1 (in the zone between the first rotational phase R1 and the second rotational phase R2), the cam diameter becomes shortest at a central phase (hereinafter referred to as a first central phase RS) serving as the minimum point, and the cam diameter gradually increases as it separates from the central phase. Similarly, also in a rotational phase range of the cam 530 in the second retention zone HD2 (in the zone between the third rotational phase R3 and the fourth rotational phase R4), the cam diameter becomes shortest at a central phase (hereinafter referred to as a second central phase RM) serving as the minimum point, and the cam diameter gradually increases as it separates from the central phase. Similarly, also in a rotational phase range of the cam 530 in the third retention zone HD3 (in the zone between the fifth rotational phase R5 and the sixth rotational phase R6), the cam diameter becomes shortest at a central phase (hereinafter referred to as a third central phase RL) serving as the minimum point, and the cam diameter gradually increases as it separates from the central phase. Note that, as illustrated in FIG. 4, the cam diameter at the second central phase RM is larger than the cam diameter at the first central phase RS, and the cam diameter at the third central phase RL is larger than the cam diameter at the second central phase RM.

In each of the retention zones HD1 to HD3, when the roller 341 of the control shaft 340 deviates from the cam surface at the central phase as the minimum point, the component force of the axial force acts to return the rotational phase of the cam back to the central phase. When the roller 341 makes contact with the cam surface of the retention zone due to the action of the component force, the rotational phase of the cam 530 is naturally directed toward the central phase in the retention zone, and the rotational phase of the cam 530 is stabilized at the central phase. On that account, a driving force to be generated from the motor 210 so as to retain the phase of the cam 530 can be made small at this time. For example, even if a holding current of the motor 210 is set to "0," the rotational phase of cam 530 can be retained at the central phase of the retention zone.

In the meantime, change zones (a first change zone constituting a zone between the second rotational phase R2 and the third rotational phase R3, and a second change zone constituting a zone between the fourth rotational phase R4 and the fifth rotational phase R5) formed so that the cam diameter continuously changes are formed between the retention zones HD1 and HD2 and between the retention zones HD2 and HD3 in the cam surface of the cam 530. More specifically, the first and second change zones are formed so that the cam diameter gradually increases as the rotational phase of the cam 530 changes in one direction.

Even when the control shaft 340 (more specifically, the roller 341) makes contact with the change zone of the cam 530, the component force of the axial force acts so as to rotate the cam 530 in the direction where the cam diameter decreases. On that account, in order to pivot the cam 530 in a direction where the cam diameter increases, it is necessary to generate a relatively large driving force in the motor 210 so as to pivot the cam 530 against the component force of the axial force. In the meantime, when the cam 530 is pivoted in the direction where the cam diameter decreases, the component force of the axial force acts to assist for a rotation of the cam 530, so that a driving force generated by the motor 210 can be restrained to be small.

Next will be described a relationship between the rotational phase of the cam 530 and a displacement amount of the control shaft 340. As illustrated in FIG. 4, when the rotational phase of the cam 530 is placed in the first retention zone HD1 (between the first rotational phase R1 and the second rotational phase R2), the displacement amount of the control shaft 340 is maintained at "0" due to the minimum point and the action of the component force of the axial force. Note that the displacement amount is a moving amount of the control shaft 340 from a reference position in the axial direction, and a position of the control shaft 340 at the time when the roller 341 makes contact with the cam surface of the cam 530 at the first central phase RS is the reference position.

When the rotational phase of the cam 530 is placed in the first change zone (between the second rotational phase R2 and the third rotational phase R3), the displacement amount of the control shaft 340 gradually increases from a base point of "0" as the rotational phase of the cam 530 increases.

When the rotational phase of the cam 530 is placed in the second retention zone HD2 (between the third rotational phase R3 and the fourth rotational phase R4), the displacement amount of the control shaft 340 is maintained at a first displacement amount L1 due to the minimum point and the action of the component force of the axial force. Here, the cam diameter in the second central phase RM is larger than the cam diameter in the first central phase RS, so the first displacement amount L1 is an amount larger than "0."

When the rotational phase of the cam 530 is placed in the second change zone (between the fourth rotational phase R4 and the fifth rotational phase R5), the displacement amount of the control shaft 340 gradually increases from the first displacement amount L1 as a base point, as the rotational phase of the cam 530 increases.

When the rotational phase of the cam 530 is placed in the third retention zone HD3 (between the fifth rotational phase R5 and the sixth rotational phase R6), the displacement amount of the control shaft 340 is maintained at a second displacement amount L2 due to the minimum point and the action of the component force of the axial force. Here, the cam diameter at the third central phase RL is larger than the cam diameter at the second central phase RM, so the second displacement amount L2 is an amount larger than the first displacement amount L1.

Since the cam surface of the cam 530 has a cam profile based on the above cam diagram, the maximum lift amount VL of the intake valve 31 changes along with changes in the rotational phase of the cam 530 as follows.

As illustrated in FIG. 5, as a rotational phase of the motor 210 increases, the rotational phase of the cam 530 gradually increases. When the rotational phase of the cam 530 is placed in the first retention zone HD1 (between the first rotational phase R1 and the second rotational phase R2), the displacement amount of the control shaft 340 is maintained at "0," so that the maximum lift amount VL of the intake valve 31 is maintained at a first lift amount VL1. Note that the first lift amount VL1 is a minimum value of the maximum lift amount VL that is set to be variable.

Further, when the rotational phase of the cam 530 is placed in the first change zone (between the second rotational phase R2 and the third rotational phase R3), the displacement amount of the control shaft 340 gradually increases as the rotational phase of the cam 530 increases, so that the maximum lift amount VL of the intake valve 31 gradually increases from the first lift amount VL1 as a base point.

When the rotational phase of the cam 530 is placed in the second retention zone HD2 (between the third rotational phase R3 and the fourth rotational phase R4), the displacement amount of the control shaft 340 is maintained at the first displacement amount L1, so that the maximum lift amount VL of the intake valve 31 is maintained at a second lift amount VL2, which is larger than the first lift amount VL1.

Further, when the rotational phase of the cam 530 is placed in the second change zone (between the fourth rotational phase R4 and the fifth rotational phase R5), the displacement amount of the control shaft 340 gradually increases as the rotational phase of the cam 530 increases, so that the maximum lift amount VL of the intake valve 31 gradually increases from the second lift amount VL2 as a base point.

Then, when the rotational phase of the cam 530 is placed in the third retention zone HD3 (between the fifth rotational phase R5 and the sixth rotational phase R6), the displacement amount of the control shaft 340 is maintained at the second displacement amount L2, so that the maximum lift amount VL of the intake valve 31 is maintained at a third lift amount VL3, which is larger than the second lift amount VL2. Note that the third lift amount VL3 is a maximum value of the maximum lift amount VL that is set to be variable.

In the variable valve mechanism 600 of the present embodiment, any of the first lift amount VL1, the second lift amount VL2, and the third lift amount VL3 is selected as the target lift amount VLp of the intake valve 31 according to an engine operation state. Then, the maximum lift amount thus selected is retained. Hereby, the maximum lift amount VL of the intake valve 31 is changed selectively at three stages according to the engine operation state.

Figure 6:
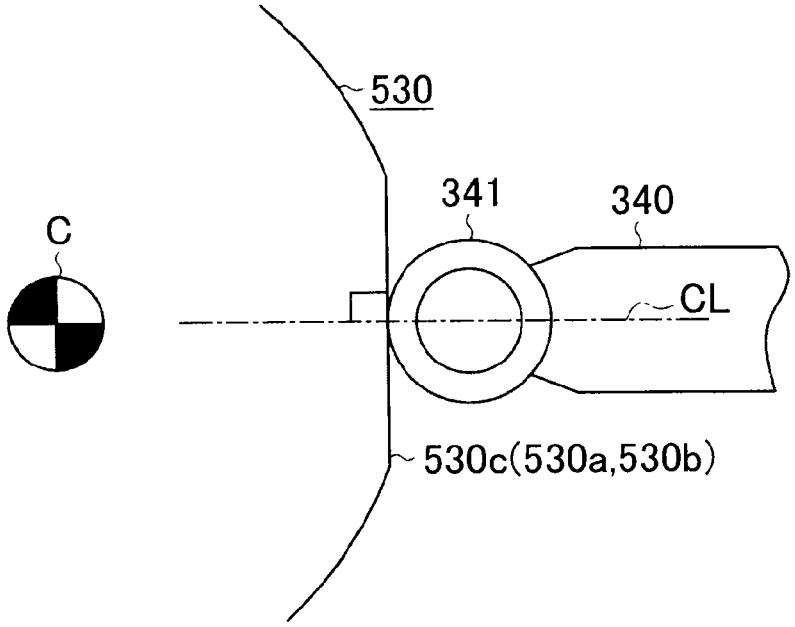
FIG. 6 is a magnified view illustrating a state where a control shaft abuts with a retention zone of the cam.

Next will be described an operation of the cam 530. As illustrated in FIG. 6, in a case where the control shaft 340 perpendicularly abuts with the third flat portion 530*c* constituting the third retention zone HD3, the component force of the axial force does not occur in an abutment portion between the cam 530 and the control shaft 340, so the cam 530 does not rotate. Similarly, in terms of the second flat portion 530*b* or the first flat portion 530*a*, in a case where the control shaft 340 perpendicularly abuts therewith, the cam 530 does not rotate.

Figure 7:
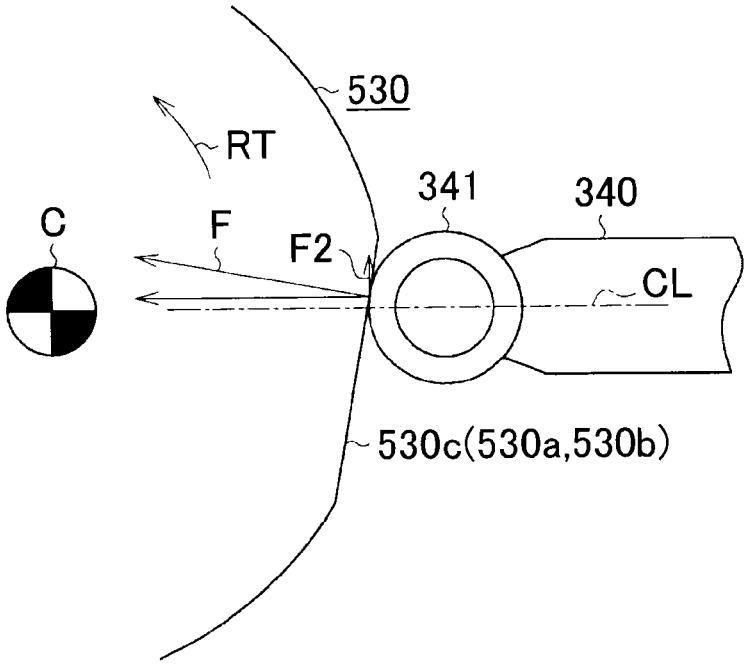
FIG. 7 is a magnified view illustrating a state where a control shaft abuts with the retention zone of the cam.

In the meantime, FIG. 7 illustrates a state where the control shaft 340 does not perpendicularly abut with the third flat portion 530*c* constituting the third retention zone HD3. Note that, also in terms of the second flat portion 530*b* or the first flat portion 530*a*, the control shaft 340 may not perpendicularly abut therewith.

Incidentally, such a state where the control shaft 340 does not perpendicularly abut may occur, for example, in a case where, as a result of a rotational phase control of the cam 530, a rotational phase K at the time when the maximum lift amount VL is retained deviates from the third central phase RL, the second central phase RM, or the first central phase RS. Further, such a state may also occur in a case where the rotation center CR of the roller 341 or the rotation center C of the cam 530 deviates from the extended line of the central axis CL of the control shaft 340.

As illustrated in FIG. 7, in a case where the control shaft 340 does not perpendicularly abut with the third flat portion 530*c* constituting the third retention zone HD3, a component force F2 of the axial force F occurs in the abutment portion between the cam 530 and the control shaft 340, so that a running torque RT caused due to the component force F2 acts on the cam 530. Similarly, also in terms of the second flat portion 530*b* or the first flat portion 530*a*, in a case where the control shaft 340 does not perpendicularly abut therewith, the running torque RT caused due to the component force F2 acts on the cam 530.

Since a magnitude of an axial force F periodically changes according to changes in a compression amount of the valve spring 24 along with opening/closing operations of the intake valve 31, a magnitude of the running torque RT also periodically changes in accordance with such periodic changes in the axial force F. The cam 530 swings due to such periodic changes in the running torque RT.

Here, as the compression amount of the valve spring 24 is larger, that is, as the maximum lift amount VL set to be variable is larger, a maximum value of the axial force F becomes larger. Further, as the maximum value of the axial force F becomes larger, a maximum value of the component force F2 also becomes larger. Accordingly, a swing amount at the time when the cam 530 swings in the above mode increases, as a retained maximum lift amount VL is larger and the axial force F is hereby larger. Accordingly, in a case where the maximum lift amount VL is relatively large, the swing amount of the cam 530 might increase excessively. In some cases, the control shaft 340 (more strictly, the roller 341) that should abut with the cam surface in the retention zone of the cam 530 deviates from the retention zone, which might cause the control shaft 340 to abut with the cam surface in the change zone. Note that, in a feedback control to control the rotational phase of the cam 530, as the swing amount of the cam 530 is larger, the increase and decrease of a feedback controlled amount related to the rotational phase control becomes remarkable. On that account, large hunting occurs in the rotational phase of the cam 530 to be feedback-controlled, which may promote the swing of the cam 530, so that the swing amount might easily increase.

When the control shaft 340 deviates from the retention zone of the cam 530 as such, it is difficult to obtain an effect to retain the maximum lift amount VL by use of the retention zone, for example, that is, an effect to be able to retain the maximum lift amount VL at a constant value even if current application to the motor 210 is stopped as described above. This accordingly causes inconvenience that power consumption of the motor 210 increases, and so on.

In this regard, in the present embodiment, respective lengths of the retention zones HD1 to HD3 are set so as to become longer in order of the first retention zone HD1<the second retention zone HD2<the third retention zone HD3, as described above. That is, respective lengths of the retention zones HD1 to HD3 are set so that a retention zone with a larger maximum lift amount VL to be retained becomes longer, and a retention zone in which a swing amount at the time when the cam 530 swings due to the axial force F transmitted from the control shaft 340 easily increases has a longer length. Accordingly, even if the swing amount of the cam 530 becomes large, the abutment portion between the control shaft 340 and the cam 530 is hard to deviate from the retention zone.

In the meantime, when the retention zone is set to be long, a necessary rotational phase amount of the cam 530 to change the abutment portion between the control shaft 340 and the cam 530 from the retention zone to the change zone becomes large. Accordingly, a change velocity to change the maximum lift amount VL decreases.

In this regard, in the present embodiment, a retention zone with a larger maximum lift amount VL to be retained is set to have a longer length, whereas a retention zone with a smaller maximum lift amount VL to be retained is set to have a shorter length. Accordingly, in comparison with a case where all the retention zones (the first retention zone HD1, the second retention zone HD2, and the third retention zone HD3) are set to have sufficiently long lengths in accordance with a maximum value of the swing amount of the cam 530, a retention zone with a smaller maximum lift amount VL to be retained has a smaller necessary rotational phase amount of the cam 530 to change the abutment portion from the retention zone to the change zone. Accordingly, it is possible to appropriately restrain a decrease in a change velocity to change the maximum lift amount VL.

Further, as illustrated in FIG. 4, the cam profile of each of the retention zones HD1 to HD3 has a shape in which the cam diameter gradually increases after the cam diameter gradually decreases as the rotational phase of the cam 530 changes in one direction, that is, a shape having a minimum point about the cam diameter. Accordingly, in a case where a change amount of the cam diameter relative to a rotational phase change of the cam 530 in the retention zone is maintained and the retention zone is made longer, the change amount of the cam diameter in the retention zone increases. Accordingly, when the rotational phase of the cam 530 is changed from the retention zone to the change zone so as to change the maximum lift amount VL toward an increase side, it is necessary to generate more torque from the motor 210, which increases power consumption of the motor 210.

In this regard, in the present embodiment, a retention zone with a smaller maximum lift amount VL to be retained is set to have a shorter length, as described above. Accordingly, it is possible to restrain the increase in power consumption of the motor 210 due to lengthening of the retention zone.

As described above, according to the above embodiment, it is possible to yield the following effects. (1) Respective lengths of the retention zones in which to retain the maximum lift amount VL are set so that a retention zone with a larger maximum lift amount VL to be retained becomes longer. Accordingly, even if the swing amount of the cam 530 becomes large, the abutment portion between the control shaft 340 and the cam 530 is hard to deviate from the retention zone.

(2) A retention zone with a larger maximum lift amount VL to be retained is set to have a longer length, whereas a retention zone with a smaller maximum lift amount VL to be retained is set to have a shorter length. Accordingly, it is possible to appropriately restrain a decrease in a change velocity to change the maximum lift amount VL. Further, it is possible to restrain an increase in power consumption of the motor 210.

(3) The cam surface of the cam 530 is provided with the first retention zone HD1 and the second retention zone HD2 so as to be adjacent to the first change zone. Further, the second retention zone HD2 and the third retention zone HD3 are provided so as to be adjacent to the second change zone. Accordingly, the maximum lift amount VL changed by use of the first change zone can be retained in the first retention zone HD1 and the second retention zone HD2 adjacent to the first change zone. Similarly, the maximum lift amount VL changed by use of the second change zone can be retained in the second retention zone HD2 and the third retention zone HD3 adjacent to the second change zone.

(4) The variable valve mechanism 600 is a mechanism in which the cam diameter of the cam 530 increases so as to increase the displacement amount of the control shaft 340, thereby increasing the maximum lift amount VL of the intake valve 31. The variable valve mechanism 600 is formed so that the cam diameter in the first and second change zones continuously changes and the cam surface in each of the retention zones HD1 to HD3 is formed to be a flat surface. According to such a configuration, since the maximum lift amount VL continuously changes in the first and second change zones, sudden changes in the intake-air amount along with changes in the maximum lift amount VL can be restrained. Accordingly, sudden changes in engine power torque due to the sudden changes in the intake-air amount can be restrained, for example.

Further, the cam surface in each of the retention zones HD1 to HD3 is formed to be a flat surface. Accordingly, when the control shaft 340 makes contact with the cam surface in each of the retention zones HD1 to HD3, the rotational phase of the cam 530 is naturally directed toward the minimum point (the central phase) in the retention zone, and the maximum lift amount VL is retained at an amount according to the cam diameter at the minimum point (the central phase). Accordingly, with such a simple structure in which the cam 530 includes a cam surface in which the cam diameter continuously changes and a cam surface formed to be a flat surface, it is possible to embody change and retention of the maximum lift amount VL.

Note that the above embodiment can be modified as follows. —The variable valve mechanism 600 is a mechanism that changes the maximum lift amount of the intake valve 31 at three stages, but the number of stages to change the maximum lift amount can be modified appropriately.

The shape of the cam 530 is one example, and the cam 530 may have other shapes provided that the control shaft 340 can move in the axial direction. —A flat part is provided in the cam surface so as to provide a minimum point in the cam diameter, but such a minimum point may be provided in other shapes.

A flat part is provided in the cam surface so as to retain the maximum lift amount VL, and hereby, a minimum point in the cam diameter is provided. Alternatively, a zone in which the cam diameter is constant and does not change may be provided in the cam surface so as to retain the maximum lift amount VL.

Figure 8:
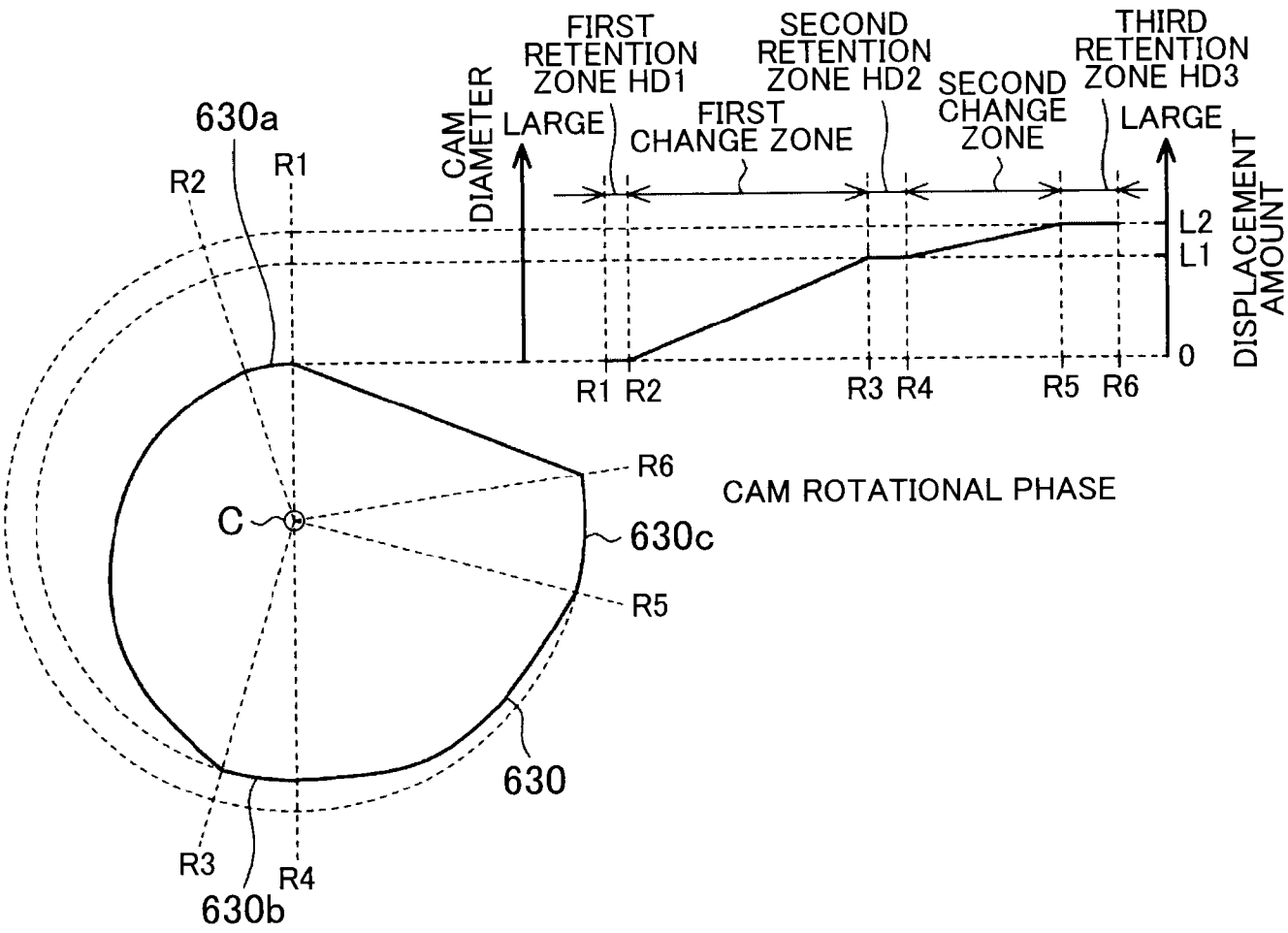
FIG. 8 is a view illustrating a profile and a cam diagram of a cam in another embodiment.

FIG. 8 illustrates a cam 630 in such a modification. A cam diagram illustrating a relationship between a rotational phase of the cam 630 and a displacement amount of a control shaft 340 is illustrated on a right side in FIG. 8, and a cam profile (an actual shape of the cam 630) formed based on the cam diagram is illustrated on a left side in FIG. 8. Further, the cam 530 of the above embodiment and the cam 630 of the modification are different in cam diagrams and cam profiles of retention zones in which to retain a maximum lift amount VL, that is, cam diagrams and cam profiles of a first retention zone HD1, a second retention zone HD2, and a third retention zone HD3. The following describes the cam 630 mainly about such different points.

As illustrated in FIG. 8, change zones formed so that a cam diameter continuously changes are also formed in a cam surface of the cam 630. More specifically, change zones (a first change zone constituting a zone between a second rotational phase R2 and a third rotational phase R3, and a second change zone constituting a zone between a fourth rotational phase R4 and a fifth rotational phase R5 in FIG. 8) in which a displacement amount of the control shaft 340 linearly increases as the cam diameter gradually increases in one direction are provided in the cam surface of the cam 630.

Further, the cam surface of the cam 630 is provided with three retention zones in each of which the cam diameter is constant and the displacement amount of the control shaft 340 is constant. More specifically, a first retention portion 630*a* constituting a first retention zone HD1 is provided in a zone between a first rotational phase R1 and the second rotational phase R2. A cam surface of the first retention portion 630*a* is formed so that the cam diameter is constant and does not change, and as illustrated in the cam diagram, the displacement amount of the control shaft 340 is set to "0" in the first retention zone HD1. Accordingly, in the first retention zone HD1, the maximum lift amount VL is retained at the first lift amount VL1.

Further, a second retention portion 630*b* constituting a second retention zone HD2 is provided in a zone between the third rotational phase R3 and the fourth rotational phase R4. A cam surface of the second retention portion 630*b* is also formed so that the cam diameter is constant and does not change, and the cam diameter in the second retention portion 630*b* is larger than the cam diameter in the first retention portion 630*a*. As illustrated in the cam diagram, the displacement amount of the control shaft 340 is retained at the first displacement amount L1 in a zone of the second retention portion 630*b*. Accordingly, in the second retention zone HD2, the maximum lift amount VL is retained at the second lift amount VL2.

Further, a third retention portion 630*c* constituting a third retention zone HD3 is provided in a zone between the fifth rotational phase R5 and a sixth rotational phase R6. A cam surface of the third retention portion 630*c* is also formed so that the cam diameter is constant and does not change, and the cam diameter in the third retention portion 630*c* is larger than the cam diameter in the second retention portion 630*b*. As illustrated in the cam diagram, the displacement amount of the control shaft 340 is retained at the second displacement amount L2 in a zone of the third retention portion 630*c*. Accordingly, in the third retention zone HD3, the maximum lift amount VL is retained at the third lift amount VL3.

Even in such a modification, since the maximum lift amount VL changes continuously in the first and second change zones, sudden changes of the intake-air amount along with changes of the maximum lift amount VL can be restrained. Accordingly, sudden changes in engine power torque due to the sudden changes in the intake-air amount can be restrained, for example.

Further, in this modification, since the cam diameter in each of the retention zones HD1 to HD3 is formed so as to be constant, the displacement amount of the control shaft 340 does not change in each of the retention zones HD1 to HD3. Accordingly, the maximum lift amount VL in each of the retention zones HD1 to HD3 is retained at an amount according to the cam diameter thus formed to be constant. Accordingly, even in this modification, with such a simple structure in which the cam 630 includes a cam surface in which the cam diameter continuously changes and a cam surface formed so that the cam diameter is constant, it is possible to embody change and retention of the maximum lift amount VL.

Also in the cam 630 of the modification, respective lengths of the retention zones HD1 to HD3 are set so as to become longer in order of the first retention zone HD1<the second retention zone HD2<the third retention zone HD3, as illustrated in the cam diagram of FIG. 8. In other words, in a case where a rotational phase amount between the first rotational phase R1 and the second rotational phase R2 is assumed a reference amount, a rotational phase amount between the third rotational phase R3 and the fourth rotational phase R4 is set to be larger than the reference amount. Further, a rotational phase amount between the fifth rotational phase R5 and the sixth rotational phase R6 is set to be larger than the rotational phase amount between the third rotational phase R3 and the fourth rotational phase R4.

Figure 9:
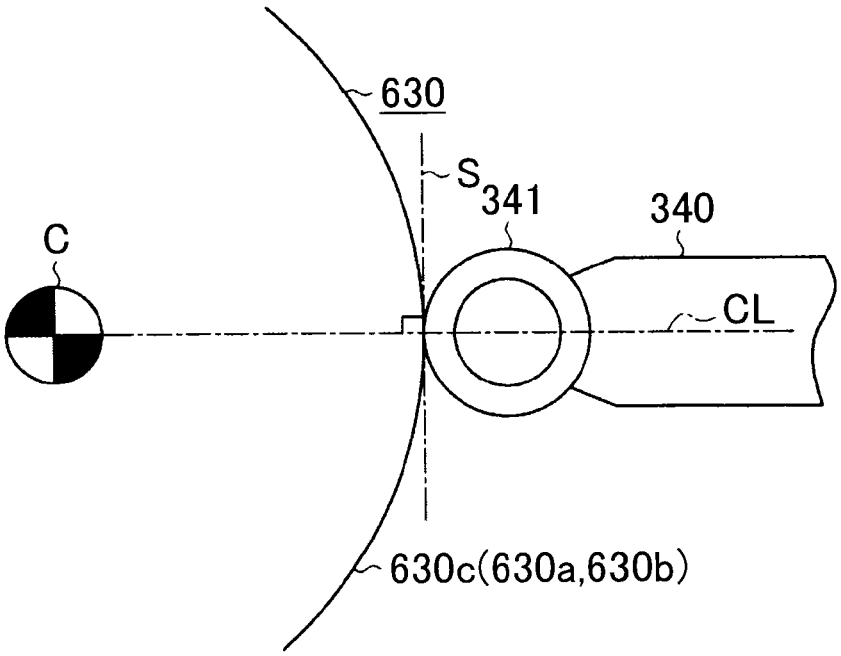
FIG. 9 is a magnified view illustrating a state where a control shaft abuts with a retention zone of a cam in another embodiment.

As illustrated in FIG. 9, in a state where the control shaft 340 abuts with the third retention portion 630*c* constituting the third retention zone HD3, the cam diameter is constant, so a tangent S at an abutment portion between the cam 630 and the control shaft 340 is perpendicular to a central axis CL of the control shaft 340. Accordingly, the aforementioned component force F2 of the axial force F does not occur, so that the cam 630 does not rotate. Similarly, in terms of the second retention portion 630*b* or the first retention portion 630*a*, if the tangent S is perpendicular to the central axis CL of the control shaft 340, the cam 630 does not rotate in a state where the control shaft 340 abuts therewith.

Figure 10:
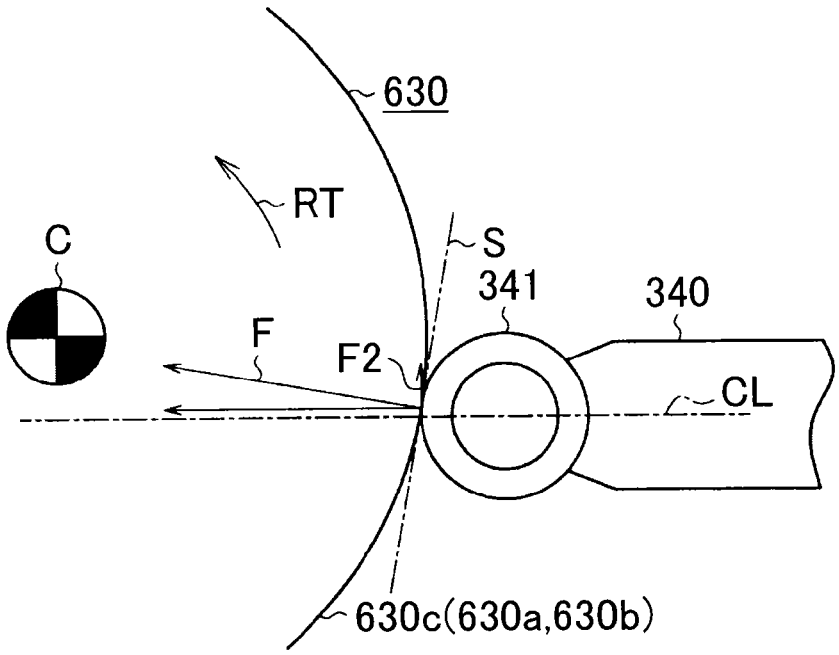
FIG. 10 is a magnified view illustrating a state where a control shaft abuts with a retention zone of a cam in another embodiment.

In the meantime, FIG. 10 illustrates a state where the control shaft 340 abuts with the third retention portion 630*c* constituting the third retention zone HD3, but the tangent S is not perpendicular to the central axis CL of the control shaft 340. Note that, also in terms of the second retention portion 630*b* or the first retention portion 630*a*, the tangent S may not be perpendicular to the central axis CL of the control shaft 340.

Incidentally, the state where the tangent S is not perpendicular to the central axis CL of the control shaft 340 may be caused in a case where a rotation center C of the cam 630 or a rotation center CR of a roller 341 deviates from an extended line of the central axis CL of the control shaft 340.

As illustrated in FIG. 10, in a case where the tangent S is not perpendicular to the central axis CL of the control shaft 340, the aforementioned component force F2 of the axial force F occurs in the abutment portion between the cam 630 and the control shaft 340, so that a running torque RT caused due to the component force F2 acts on the cam 630. Similarly, in terms of the second retention portion 630*b* or the first retention portion 630*a*, in a case where the tangent S is not perpendicular to the central axis CL of the control shaft 340, the running torque RT caused due to the component force F2 acts on the cam 630. Accordingly, the cam 630 having the retention zones in which the cam diameter is constant may also have a problem similar to the cam 530, and the control shaft 340 (more strictly, the roller 341) that should abut with the cam surface in the retention zone of the cam 630 may deviate from the retention zone, thereby causing the control shaft 340 to abut with the cam surface in the change zone.

In this regard, also in this modification, respective lengths of the retention zones HD1 to HD3 are set so as to become longer in order of the first retention zone HD1<the second retention zone HD2<the third retention zone HD3, similarly to the above embodiment. Accordingly, it is possible to obtain the same effect as in the above embodiment. That is, respective lengths of the retention zones HD1 to HD3 are set so that a retention zone with a larger maximum lift amount VL to be retained becomes longer, and a retention zone in which a swing amount at the time when the cam 630 swings due to the axial force F transmitted from the control shaft 340 easily increases has a longer length. Accordingly, even if the swing amount of the cam 630 becomes large, the abutment portion between the control shaft 340 and the cam 630 is hard to deviate from the retention zone.

Further, in this modification, a retention zone with a larger maximum lift amount VL to be retained is set to have a longer length, whereas a retention zone with a smaller maximum lift amount VL to be retained is set to have a shorter length. Accordingly, in comparison with a case where all the retention zones (the first retention zone HD1, the second retention zone HD2, and the third retention zone HD3) are set to have sufficiently long lengths in accordance with a maximum value of the swing amount of the cam 630, a retention zone with a smaller maximum lift amount VL to be retained has a smaller necessary rotational phase amount of the cam 630 to change the abutment portion from the retention zone to the change zone. Accordingly, similarly to the above embodiment, it is possible to appropriately restrain a decrease in a change velocity to change the maximum lift amount VL.

The variable mechanism portion 300 is a mechanism that can change the maximum lift amount and the valve opening period of the intake valve 31. Alternatively, the variable mechanism portion 300 may be a mechanism that can change only the maximum lift amount. —The variable mechanism portion 300 is provided in a valve train system of the intake valve 31, but may be provided in a valve train system of the exhaust valve 41.

The following describes a technical idea that can be understood from the above embodiment and its modification. In the above variable valve mechanism for an internal combustion engine, a rotational phase of the cam may be feedback-controlled so as to become a target rotational phase according to a target maximum lift amount.

According to the configuration above, even if the swing of the cam is promoted due to the feedback control and a swing amount of the cam might easily increase, the effects as described in the above embodiment and its modification can be obtained. Accordingly, it is possible to restrain the abutment portion between the control shaft and the cam from deviating from the retention zone due to the increase in the swing amount of the cam.

What is claimed is:

1. A variable valve mechanism for an internal combustion engine, the variable valve mechanism comprising:

a control shaft configured to be displaced in an axial direction of the control shaft, the control shaft being configured to change a maximum lift amount of an engine valve of the internal combustion engine according to displacement of the control shaft in the axial direction; and a cam including a cam surface of the cam, the cam surface configured to abut with the control shaft, the cam being configured to displace the control shaft in the axial direction due to rotation of the cam, the cam surface including change zones and retention zones, the cam surface in the change zones being configured to change the maximum lift amount along with the rotation of the cam, the cam surface in the retention zones being configured to retain the maximum lift amount along with the rotation of the cam, respective lengths of the retention zones in a rotation direction of the cam being set such that respective length of the retention zones in the rotation direction increases as the maximum lift amount retained by the retention zones increases.

2. The variable valve mechanism according to claim 1, wherein in the cam surface, the retention zones are provided so as to be adjacent to the change zones.

3. The variable valve mechanism according to claim 1, wherein:

the cam surface in the change zones is configured such that a cam diameter of the cam continuously increases along with the rotation of the cam such that the maximum lift amount increases along with the rotation of the cam; and the cam surface in the retention zones is a flat surface.

4. The variable valve mechanism according to claim 1, wherein:

the cam surface in the change zones is configured such that a cam diameter of the cam continuously increases along with the rotation of the cam such that the maximum lift amount increases along with the rotation of the cam; and the cam surface in the retention zones is configured such that the cam diameter is constant.

* * * * *